US010034540B1

(12) United States Patent
Abbott et al.

(10) Patent No.: US 10,034,540 B1
(45) Date of Patent: Jul. 31, 2018

(54) MOTORIZED SHELF ASSEMBLY

(71) Applicant: Superior Motorized Shelving Systems, LLC, Carlsbad, CA (US)

(72) Inventors: Nicholas J Abbott, Carlsbad, CA (US); Rick Lee Taylor, Sylmar, CA (US)

(73) Assignee: Superior Motorized Shelving Systems, LLC, Carlsbad, CA (US)

( * ) Notice: Subject to any disclaimer, the term of this patent is extended or adjusted under 35 U.S.C. 154(b) by 0 days.

(21) Appl. No.: 15/354,326

(22) Filed: Nov. 17, 2016

Related U.S. Application Data

(60) Provisional application No. 62/259,792, filed on Nov. 25, 2015.

(51) Int. Cl.

| | |
|---|---|
| ***A47B 95/02*** | (2006.01) |
| ***A47B 46/00*** | (2006.01) |
| ***A47B 51/00*** | (2006.01) |
| ***A47B 77/10*** | (2006.01) |

(52) U.S. Cl.
CPC ..... *A47B 46/005* (2013.01); *A47B 51/00* (2013.01); *A47B 77/10* (2013.01); *A47B 2220/0097* (2013.01)

(58) Field of Classification Search
CPC ..... A47B 46/005; A47B 51/00; A47B 77/00; A47B 2220/0097
See application file for complete search history.

(56) References Cited

U.S. PATENT DOCUMENTS 2,635,030 A * 4/1953 Stebbins ..... A47B 51/00 312/266
2,938,631 A * 5/1960 Brey ..... A47B 46/005 211/90.01
3,857,623 A 12/1974 Schneller
4,150,861 A 4/1979 Dufrancatel
4,915,461 A * 4/1990 Kingsborough ..... A47B 77/10 312/247
5,026,129 A * 6/1991 Merl ..... A47F 1/02 312/121
5,224,677 A * 7/1993 Close ..... A47B 51/00 211/104
5,249,858 A * 10/1993 Nusser ..... A47B 46/005 312/248

(Continued)

FOREIGN PATENT DOCUMENTS

JP 2008141923 A * 6/2008 ..... A47B 46/005

*Primary Examiner* — Hanh V Tran
(74) *Attorney, Agent, or Firm* — Shlesinger, Arkwright & Garvey LLP

(57) ABSTRACT

A cabinet includes a first shelf disposed inside the cabinet at a height above waist level, the first shelf having a retracted position and a deployed position below and outwardly from the retracted position. First and second pivot arms are pivotally operably attached to the first end the first shelf and to the cabinet, the first and second pivot arms forming a first parallelogram. Third and fourth pivot arms are pivotally operably attached a second end of the first shelf and to the cabinet below the first shelf, the third and fourth pivot arms forming a second parallelogram. A first drive motor operably is operably to one of the first and second pivot arms and the third and fourth pivot arms to swing the first and the second parallelograms outwardly and downwardly from the cabinet to position the first shelf from the retracted position to the deployed position.

15 Claims, 6 Drawing Sheets

(56) References Cited

U.S. PATENT DOCUMENTS

| | | | | |
|---|---|---|---|---|
| 5,308,158 | A | 5/1994 | Vogelgesang et al. | |
| 5,758,782 | A * | 6/1998 | Rupert | A47B 46/00 211/104 |
| 6,073,624 | A * | 6/2000 | Laurent | A47B 46/005 126/273 A |
| 6,209,405 | B1 * | 4/2001 | Milsem | A47B 46/00 108/138 |
| 6,340,214 | B1 * | 1/2002 | Adams | A47B 46/005 211/1.3 |
| 6,976,598 | B2 | 12/2005 | Engel | |
| 7,731,805 | B2 * | 6/2010 | Banta | A47L 15/506 134/56 D |
| 7,743,930 | B2 | 6/2010 | Krohn | |
| 8,061,789 | B2 * | 11/2011 | Krueger | A47B 46/005 211/100 |
| 8,414,093 | B2 | 4/2013 | Moran | |
| 8,424,693 | B1 | 4/2013 | Hoover | |
| 8,424,983 | B1 | 4/2013 | Strauss et al. | |
| 8,777,338 | B2 | 7/2014 | Bunch | |
| 9,055,813 | B2 | 6/2015 | Telthorster et al. | |
| 2007/0236114 | A1 | 10/2007 | Fuentes | |
| 2011/0266937 | A1 * | 11/2011 | Roberts | A47B 51/00 312/319.1 |
| 2014/0175962 | A1 * | 6/2014 | Hollenstein | A47B 51/00 312/319.5 |
| 2014/0203692 | A1 * | 7/2014 | Marsters | A47B 46/005 312/246 |
| 2014/0263122 | A1 | 9/2014 | Roberts et al. | |

* cited by examiner

MOTORIZED SHELF ASSEMBLY

RELATED APPLICATION

This is a nonprovisional application of Provisional Application Ser. No. 62/259,792, filed on Nov. 25, 2015, hereby incorporated by reference.

FIELD OF THE INVENTION

The present invention relates to motorized shelf assemblies.

SUMMARY OF THE INVENTION

The present invention provides a cabinet, comprising a first shelf disposed inside the cabinet at a height above waist level, the first shelf having a retracted position and a deployed position below and outwardly from the retracted position; first and second pivot arms, first ends of the first and second pivot arms are pivotally operably attached to a first end of the first shelf, second ends of the first and second pivot arms are pivotally operably attached to the cabinet below the first shelf, the first and second pivot arms forming a first parallelogram; third and fourth pivot arms, first ends of the third and fourth pivot arms are pivotally operably attached to a second end of the first shelf, second end of the third and fourth pivot arms are pivotally operably attached to the cabinet below the first shelf, the third and fourth pivot arms forming a second parallelogram; a first drive motor operably connected to one of the second ends of the first and second pivot arms and the third and fourth pivot arms to swing the first and the second parallelograms outwardly and downwardly from the cabinet to position the first shelf from the retracted position to the deployed position.

DETAILED DESCRIPTION OF THE INVENTION

Figure 1:
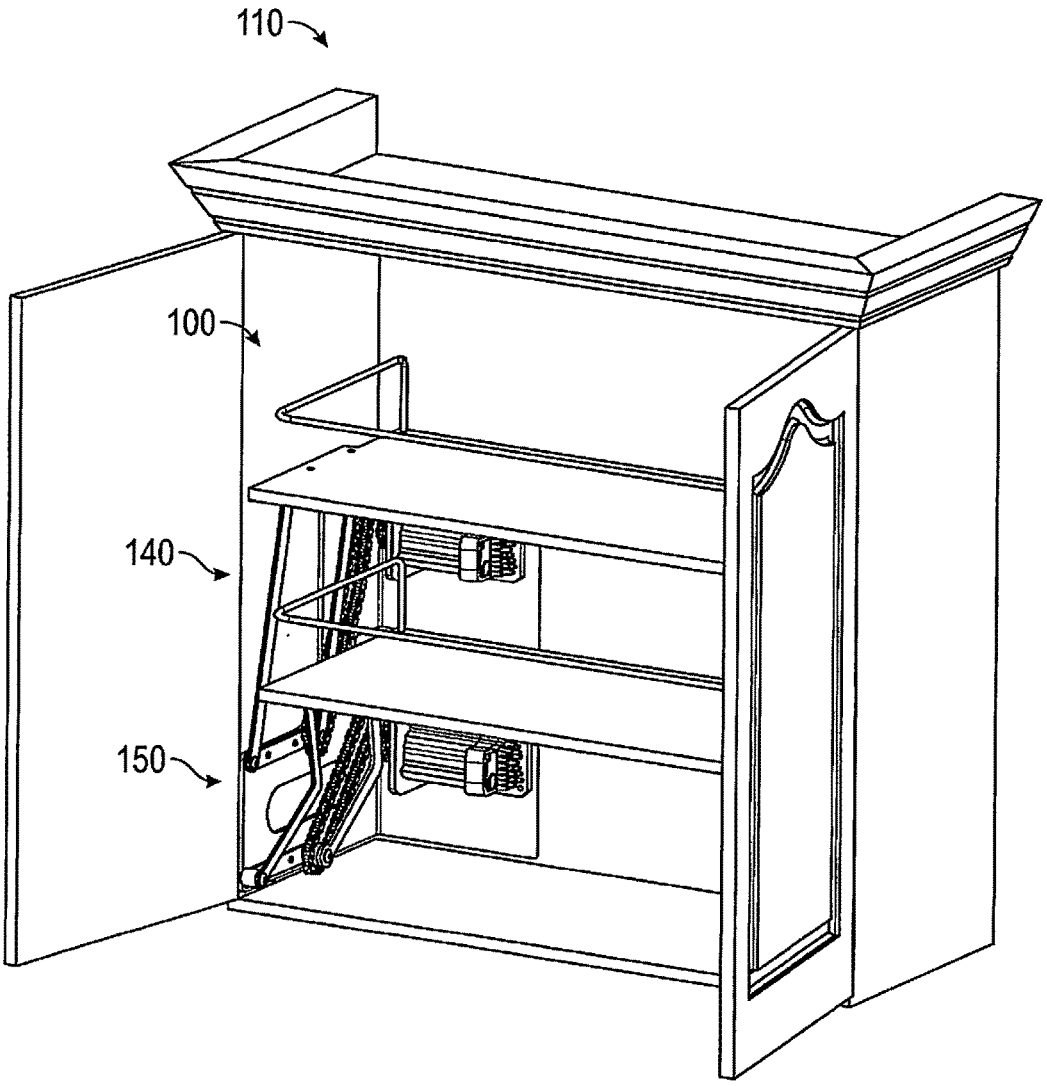
FIG. 1 is a perspective view of an embodiment of a motorized shelf assembly in a cabinet with both upper and lower shelf assemblies shown in the "up" or "retracted" position.
Figure 2:
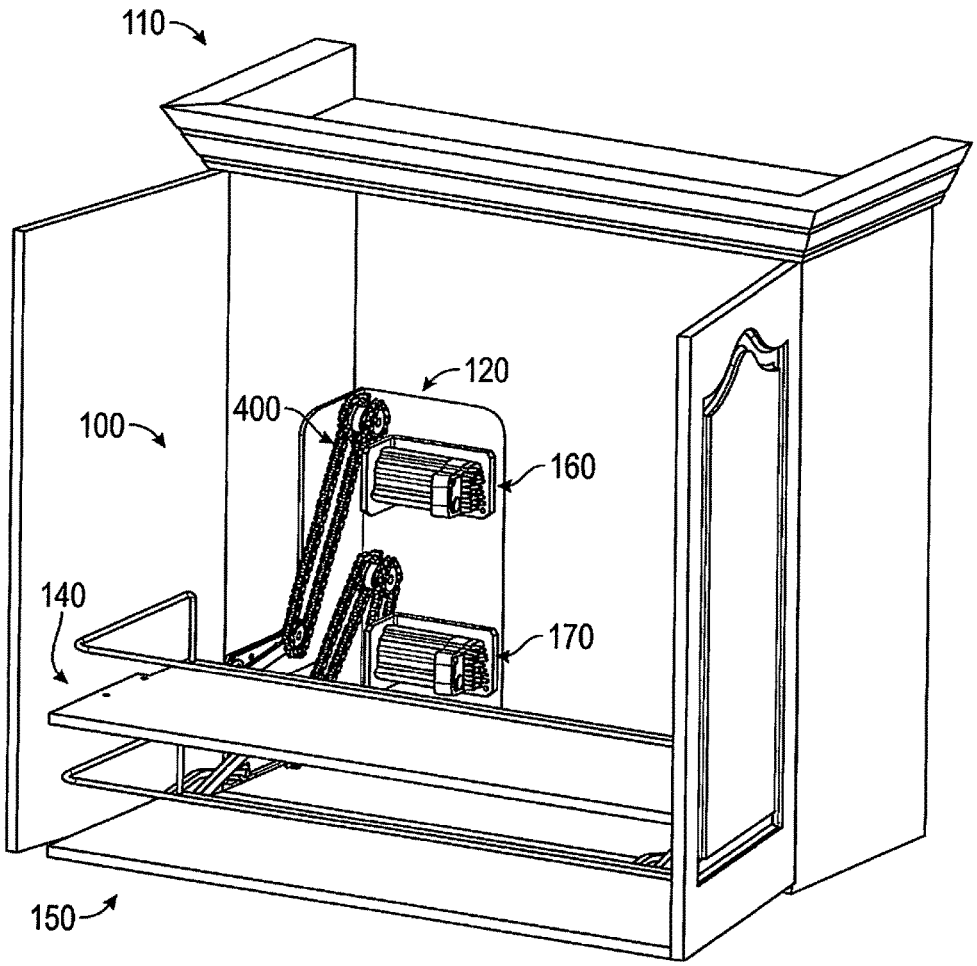
FIG. 2 is a perspective view of the motorized shelf assembly of FIG. 1 in a cabinet with both upper and lower shelf assemblies shown in the "down" or "deployed" position.
Figure 3:
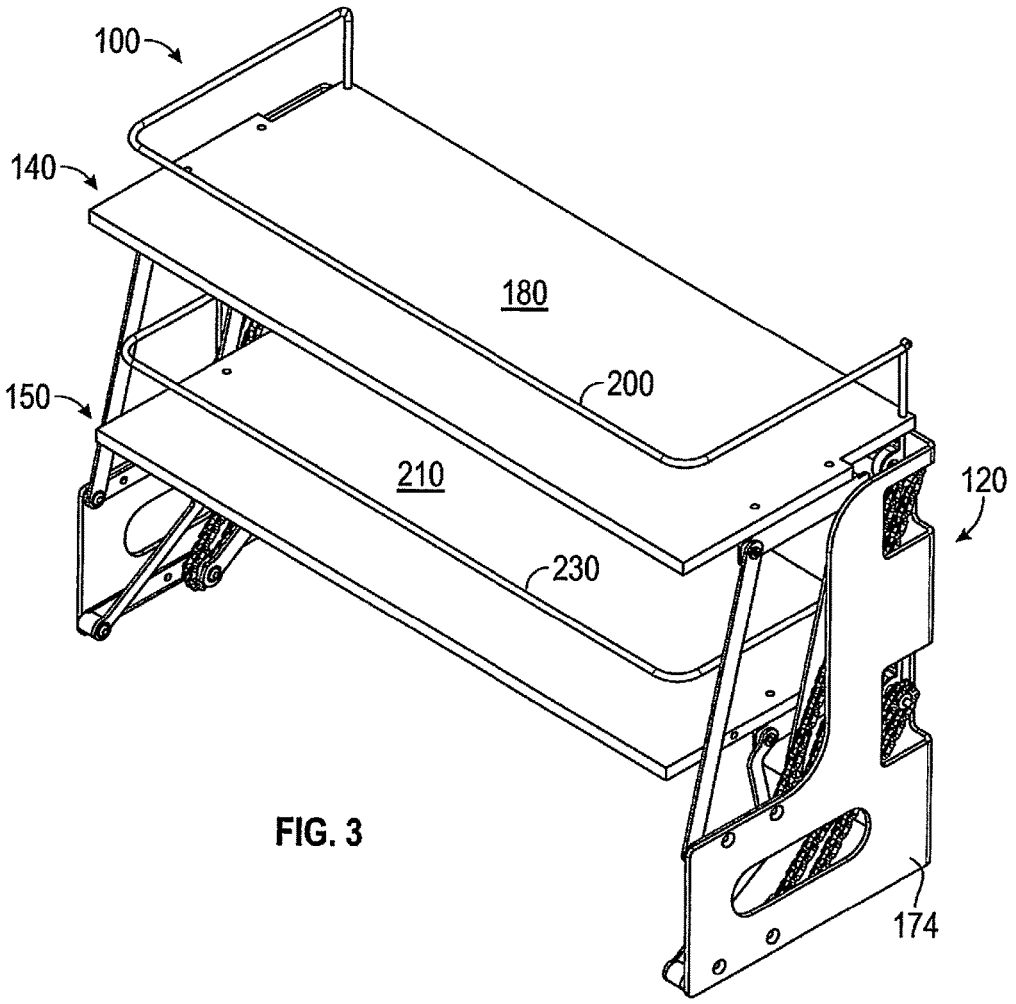
FIG. 3 is a perspective view of the motorized shelf assembly of FIGS. 1 and 2 removed from the cabinet and with both upper and lower shelf assemblies shown in the "up" or retracted" position.
Figure 4:
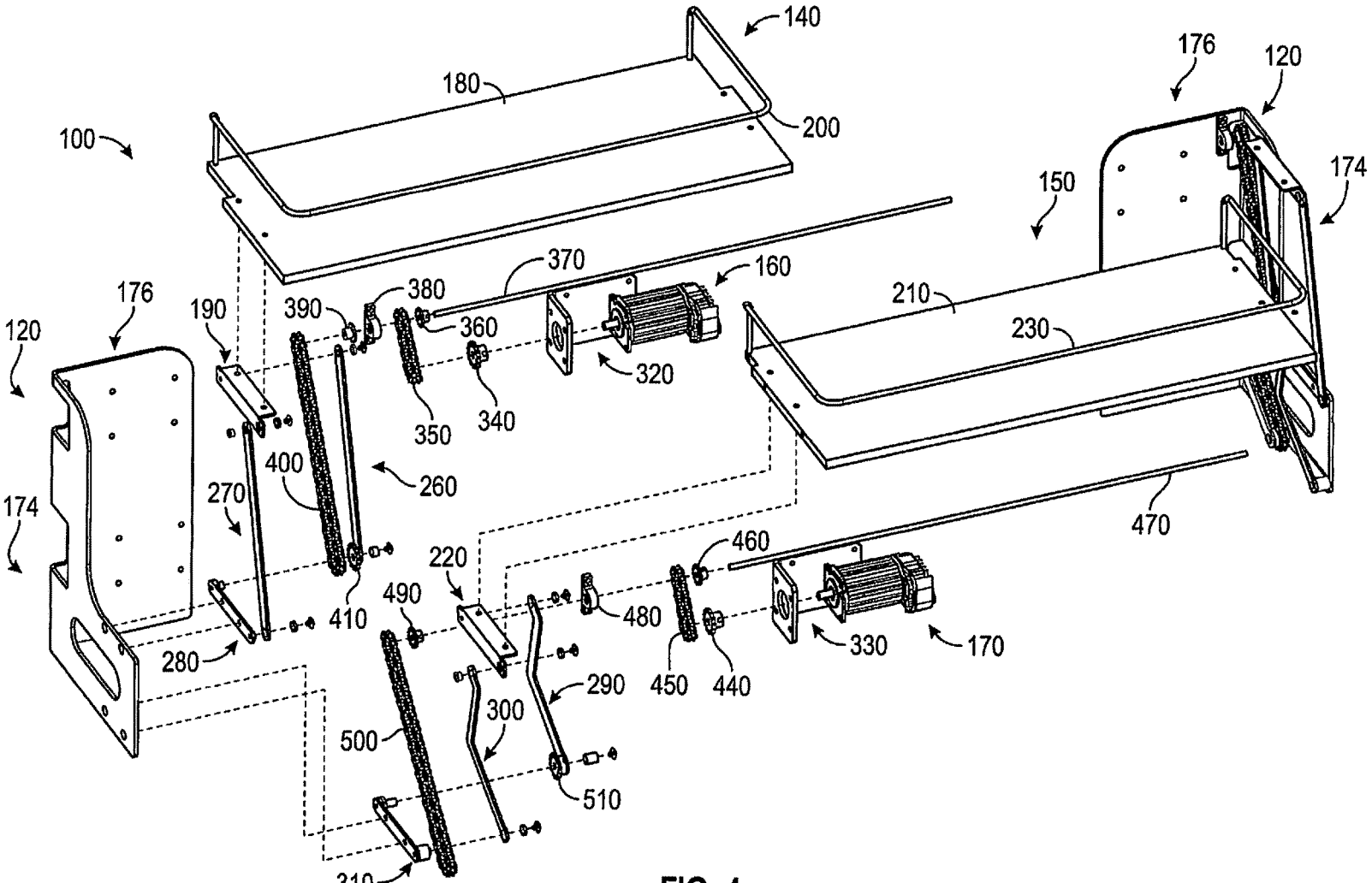
FIG. 4 is an exploded perspective view of the motorized shelf assembly of FIGS. 1-3.
Figure 5:
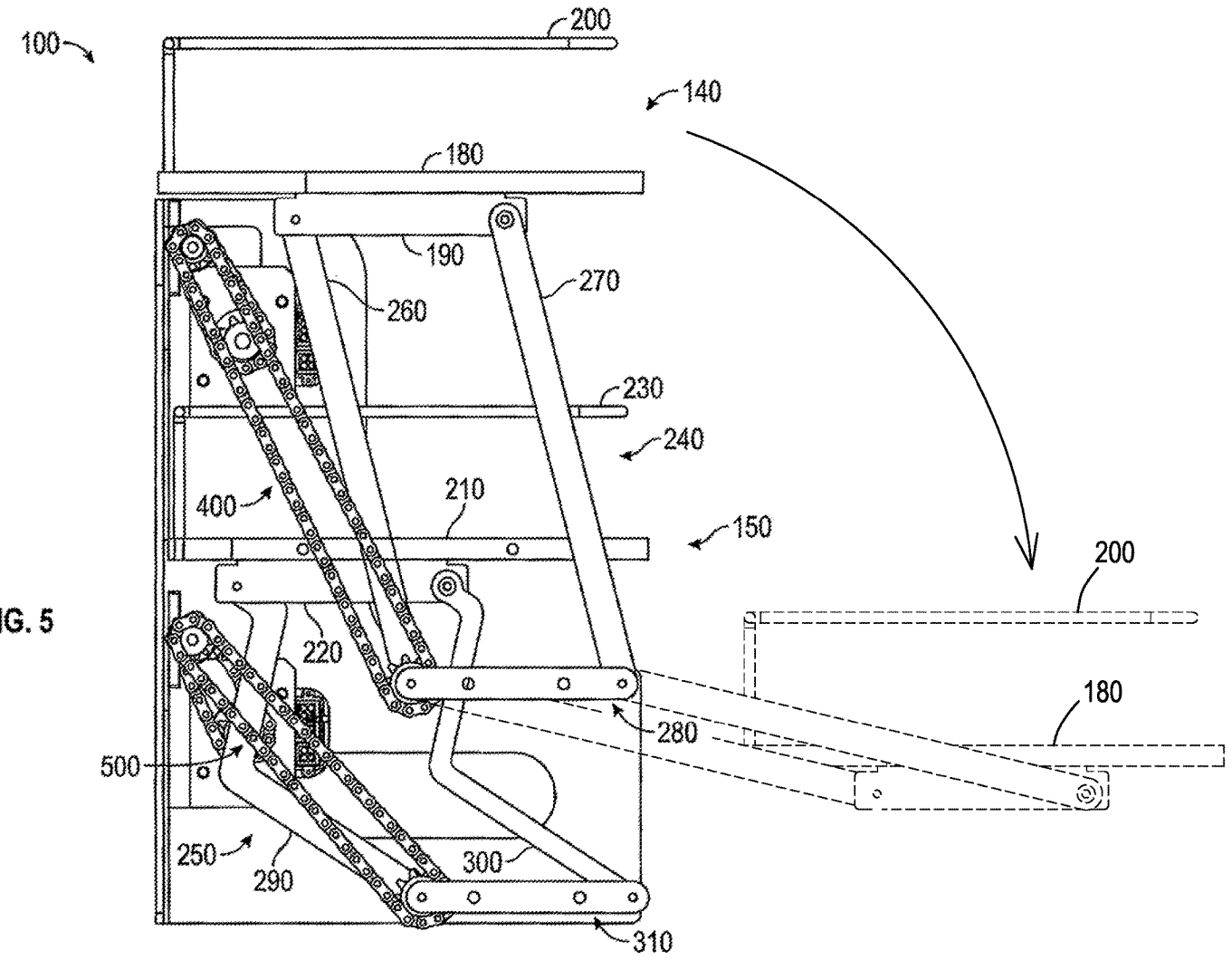
FIG. 5 is an end view of the motorized shelf assembly of FIGS. 1-4 with a mounting plate removed for clarity and with both upper and lower shelf assemblies shown in the "up" or "retracted" position.
Figure 6:
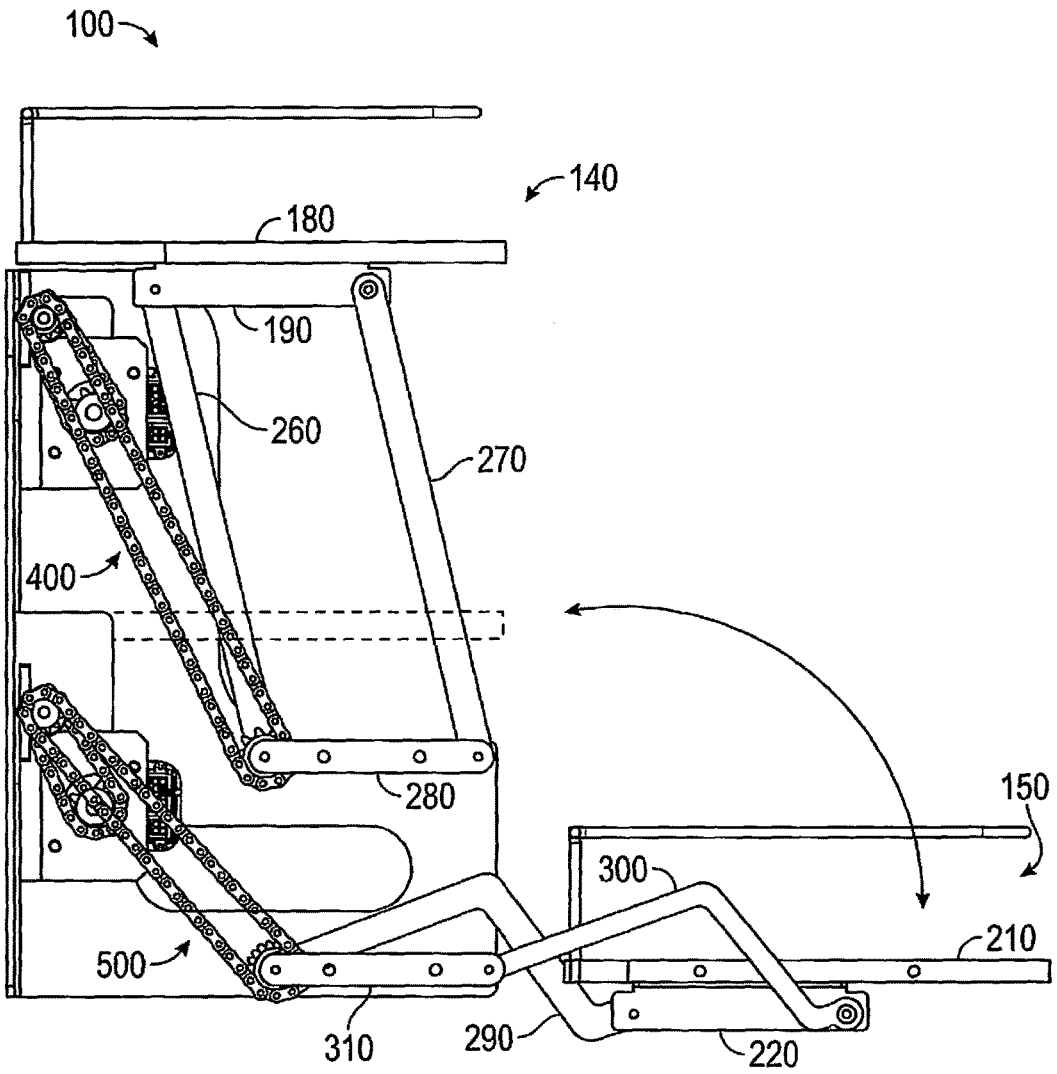
FIG. 6 is an end view of the motorized shelf assembly, similar to FIG. 5, and shows a lower shelf assembly in the "down" or "deployed" position.

With reference to FIGS. 1-6, an embodiment of motorized shelf assembly 100 for a cabinet 110 will be described. The motorized shelf assembly 100 includes a pair of mounting plates 120 along opposite ends 130 of the motorized shelf assembly 100 for mounting the motorized shelf assembly 100 within the cabinet 110. An upper shelf assembly 140 and a lower shelf assembly 150 are operably coupled to the mounting plates 120. The upper shelf assembly 140 and a lower shelf assembly 150 are driven by respective upper shelf and lower shelf motors 160, 170 for moving the upper shelf assembly 140 and the lower shelf assembly 150 between an "up" or "retracted" position and a "down" or "deployed" position.

The mounting plates 120 include an L-shaped side plate member 174 and a perpendicularly disposed rectangular rear plate member 176. The side plate member 174 and the rear plate member 176 include holes therein for mounting the mounting plates to inner sides and rear of the cabinet 110.

The upper shelf assembly 140 includes a substantially rectangular upper shelf 180 with holes along opposite sides for mounting the upper shelf 180 to mounting brackets 190. A substantially U-shaped decorative rail 200 is attached to the upper shelf 180 near opposite inner corners and is disposed a spaced height above the upper shelf 180 adjacent to two side edges and an outer edge of the upper shelf 180.

Similarly, the lower shelf assembly 150 includes a substantially rectangular lower shelf 210 with holes along opposite sides for mounting the lower shelf 210 to mounting brackets 220. A substantially U-shaped decorative rail 230 is attached to the lower shelf 210 near opposite inner comers and is disposed a spaced height above the lower shelf 210 adjacent to two side edges and an outer edge of the lower shelf 210.

The upper shelf assembly 140 and the lower shelf assembly 150 are operably coupled to the mounting plates 120 and the respective motors 160,170 via upper and lower pivoting support assemblies 240, 250.

The upper pivoting support assembly 240 includes a pair of first and second parallel straight upper shelf pivot arms 260, 270 that are pivotally connected at upper ends to the mounting brackets 190 via fasteners and are pivotally connected at lower ends to upper shelf mounting plates 280 via fasteners. The upper shelf mounting plates 280 are attached to inner surfaces of L-shaped side plate member 174 of the mounting plates 120 via fasteners.

The lower pivoting support assembly 250 includes a pair of first and second spaced V-shaped pivot arms 290, 300 that are pivotally connected at upper ends to the mounting brackets 220 via fasteners and are pivotally connected at lower ends to lower shelf mounting plates 310 via fasteners. The lower shelf mounting plates 310 are attached to inner surfaces of L-shaped side plate member 174 of the mounting plates 120 via fasteners below the upper shelf mounting plates 280. The first/second lower pivot arms 290, 300 are V-shaped or dog-legged shaped on the lower shelf to avoid hitting the lower or bottom shelf of the cabinet 110.

The upper shelf motor 160 is mounted to an inner surface of the rectangular rear plate member 176 of left mounting plate 120 via an upper motor mounting bracket 320 and fasteners.

The lower shelf motor 170 is mounted to an inner surface of the rectangular rear plate member 176 of left mounting plate 120 via lower motor mounting bracket 330 and fasteners below the upper motor mounting bracket 320.

The upper shelf motor 160 and the lower shelf motor 170 control pivoting movement of the upper shelf assembly 140 and the lower shelf assembly 150. The upper shelf motor 160 is operably coupled to the upper shelf assembly 140 for controlling pivoting movement of the upper shelf assembly 140 through chain sprocket 340, roller chain 350, sprocket 360, main shaft 370, base mounted bearing 380, sprocket 390, roller chain 400, and sprocket 410 of first upper shelf pivot arm 260. Appropriate fasteners connect relevant components together.

The lower shelf motor 170 is operably coupled to the lower shelf assembly 150 for controlling pivoting movement of the lower shelf assembly 150 through chain sprocket 440, roller chain 450, sprocket 460, main shaft 470, base mounted bearing 480, sprocket 490, roller chain 500, and sprocket 510 of first lower shelf pivot arm 290. Appropriate fasteners connect relevant components together.

Figure 7:
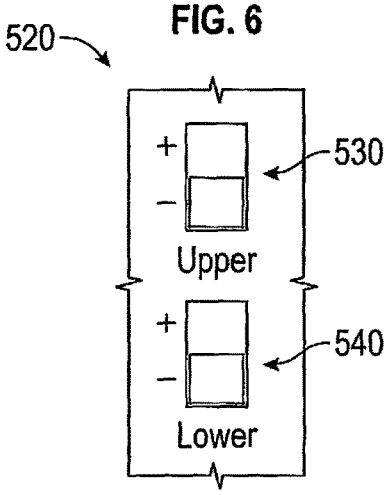
FIG. 7 is a front elevational view of an embodiment of a remote control for the motorized shelf assembly.

As shown in FIG. 7, the motorized shelf assembly 100 may include one or more controller(s) 520 to control operation of the upper shelf motor 160 and the lower shelf motor 170 for lowering and raising the upper shelf assembly 140 and the lower shelf assembly 150. The motors 160, 170 may be individually controlled and/or controlled in unison by the one or more controller(s) 520. The one or more controller(s) 520 may be directly electrically coupled and/or wirelessly coupled to the upper shelf motor 160 and the lower shelf motor 170 for controlling operation of the motors 160, 170. The controller 520 may include an upper shelf control switch 530 for lowering and raising the upper shelf assembly 140 and a lower shelf control switch 540 for lowering and raising the lower shelf assembly 150. If the one or more controller(s) 520 is/are directly electrically coupled to the motors 160, 170, the controller(s) 520 may be disposed on or adjacent to the cabinet 110. If the one or more controller (s) 520 is/are wireless coupled to the motors 160, 170, the controller(s) 520 may be one or more remote controls that include appropriate electrical hardware and/or software including transmitter(s)/transceiver(s) that wireless communicate with receiver(s)/transceiver(s) in appropriate electrical hardware and/or software in or adjacent to the cabinet 110 for controlling the motors 160, 170 wirelessly.

Although the motorized shelf assembly 100 is shown as having two shelf assemblies 140, 150, in alternative embodiments, the motorized shelf assembly 100 includes other numbers of shelf assemblies (e.g., 1, 3, 4, 5, etc.). Similarly, in alternative embodiments, the motorized shelf assembly 100 may have other numbers of motors (e.g., 1, 3, 4, 5, etc.) to control one or more shelf assemblies. For example, but not by way of limitation, a single motor may be used to control multiple shelf assemblies individually through one or more coupling/decoupling mechanisms, or in unison.

With reference to FIGS. 1, 2, 5 and 6, the motorized shelf assembly 100 will now be described in use. The shelves and shelf supports of an existing cabinet 110 are removed and replaced with the motorized shelf assembly 100. The motorized shelf assembly 100 is attached to the inner rear wall and inner side walls of the cabinet 110 through the rear plate members 176 and side plate members 174 of the mounting plates 120. The motors 160, 170 are individually controlled or controlled in unison by the one or more controller{s) 520 to control operation of the upper shelf motor 160 and the lower shelf motor 170 for lowering and raising the upper shelf assembly 140 and the lower shelf assembly 150.

To lower the lower shelf assembly 150, the doors of the cabinet 110 are opened and the lower shelf motor 170 is controlled to rotate, causing roller chain 450 to rotate. This causes sprocket 460 on main shaft 470 to rotate, causing roller chain 500 to rotate. Rotating roller chain 500 causes sprocket 510 to rotate, which causes first lower shelf pivot arm 290 to pivot downwardly. Because second lower shelf pivot arm 300 is intercoupled for movement with first lower shelf pivot arm 290, downward pivotal movement of first lower shelf pivot arm 290 causes corresponding downward pivotal movement of second lower shelf pivot arm 300, causing the lower shelf assembly 150 to move downward to the down or deployed position shown in FIG. 6.

To raise the lower shelf assembly 150, the motor 170 is controlled to rotate in an opposite direction, causing roller chain 450 to rotate. This causes sprocket 460 on main shaft 470 to rotate, causing roller chain 500 to rotate. Rotating roller chain 500 causes sprocket 510 to rotate, which causes first lower shelf pivot arm 290 to pivot upwardly. Because second lower shelf pivot arm 300 is intercoupled for movement with first lower shelf pivot arm 290, upward pivotal movement of first lower shelf pivot arm 290 causes corresponding upward pivotal movement of second lower shelf pivot arm 300, causing the lower shelf assembly 150 to move upwardly to the upward or retracted position shown in FIG. 5.

To lower the upper shelf assembly 140, the doors of the cabinet 110 are opened and the upper shelf motor 160 is controlled to rotate, causing roller chain 350 to rotate. This causes sprocket 360 on main shaft 470 to rotate, causing roller chain 400 to rotate. Rotating roller chain 400 causes sprocket 410 to rotate, which causes first upper shelf pivot arm 260 to pivot downwardly. Because second upper shelf pivot arm 270 is intercoupled for movement with first upper shelf pivot arm 260, downward pivotal movement of first upper shelf pivot arm 260 causes corresponding downward pivotal movement of second upper shelf pivot arm 270, causing the upper shelf assembly 140 to move downward to the down or deployed position shown in FIG. 2.

To raise the upper shelf assembly 140, the upper shelf motor 160 is controlled to rotate in an opposite direction, causing roller chain 350 to rotate. This causes sprocket 360 on main shaft 470 to rotate, causing roller chain 400 to rotate. Rotating roller chain 400 causes sprocket 410 to rotate, which causes first upper shelf pivot arm 260 to pivot upward. Because second upper shelf pivot arm 270 is intercoupled for movement with first upper shelf pivot arm 260, upward pivotal movement of first upper shelf pivot arm 260 causes corresponding upward pivotal movement of second upper shelf pivot arm 270, causing the upper shelf assembly 140 to move upward to the upward or retracted position shown in FIGS. 2 and 5.

As mentioned previously, the motorized shelf assembly 100 is controlled to lower one or both of the upper shelf assembly 140 and the lower shelf assembly 150. In the lowered or deployed position, a user can easily remove or add glasses, dishes, or other articles from/to the upper shelf assembly 140 and/or the lower shelf assembly 150. When the user is done removing/adding glasses, dishes, or other articles, the motorized shelf assembly 100 is controlled to raise one or both of the upper shelf assembly 140 and the lower shelf assembly 150, and the doors of the cabinet 110 are closed.

Advantages of the motorized shelf assembly 100 compared to a manual shelf assembly that manually pulls out from a cabinet include one or more of, but not limited to, the following:

Manual Shelf Assembly:

1. A manual pull and push assembly/system can be adequate at waist height or below such typical slide in/out for kitchen pots and pans under the sink. However, at or above waist height, human physical factors take over regardless if the unit is used in a kitchen or other similar application.

a. Physical factors include a person's stature, physical strength, weight of the person and motor skills such as reach or range of motion and balance.

b. In addition, for an overhead manual shelf to operate, a hand-held pole or other extension devise may be required to move the unit up or down. This is another negative situation that creates physical concerns, including an additional balancing maneuver.

2. A manual system is also limited by a maximum weight that each shelf can accommodate. It is restricted to the length of the shelf, typically 32"-44" and the height of or number of "shelves" is finite. Typically, manual shelves would be limited to only two shelves when most standard shelves are three or more.

3. Functional adaptation is also an issue. Attempting to add or adapt a motor to an existing manual shelf is basically not feasible. The entire manual shelf configuration and mechanical systems must be completely redesigned and almost nothing of the original manual shelf design is salvageable.

Motorized Shelf Assembly:

1. The motorized shelf assembly/system does not require any special physical ability. Push of a button, similar to a TV remote, will allow the shelves to move up and down.

2. A motorized unit may not be as constrained by weight of the contents within the individual shelf as with a manual shelf. For the embodiment shown herein, the shelves are being designed to accommodate about 30 lbs.

3. The physical length of the shelves and height are not restricted as with a manual design.

Applications:

Although the motorized shelf assembly 100 has been described in conjunction with a kitchen cabinet 110, the various applications of the motorized shelf assembly 100 are almost limitless. The mechanical movements/chains and motor of the motorized shelves are not very visible and are esthetically attractive. The units are adaptable for a number of applications that include residential homes and multifamily use to a number commercial uses.

With almost limitless height and number of shelves, any space sensitive facilities are considered, such as individual residential homes, apartment buildings, senior citizen, assisted living, congregate care and hospital facilities (supplies, materials and more). These units are excellent for those persons who may have some physical challenges as well as those facilities that have limited space and every useable inch of space can be used.

For commercial use it is well suited for those businesses that are in continuous use, such as stocking and restocking without the use of forklifts. They can include electronic equipment/parts, computer software/hardware, wholesale/retail automotive parts supply, food services both wholesale/retail and other operations that have small to medium inventory with space limitations. As a special note, due to the ability to extend the height of the shelves to the ceiling can help decrease the operations cost as less "storage facilities" or warehouse space is not need because all interior space can be utilized.

Moreover, as noted previously, the shelves are excellent for those who may have some physical impairment. A special advantage of the motorized unit is also possible reduced OSHA concerns and insurance claims due to trip and fall hazards associated with any manual system or use of ladders, step stools and more.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A cabinet, comprising:

a) a first shelf disposed inside the cabinet at a height above waist level, the first shelf having a retracted position and a deployed position below and outwardly from the retracted position;

b) a second shelf disposed insert inside the cabinet and below the first shelf, the second shelf being independently movable between a retracted position and a deployed position below and outwardly from the retracted position;

c) first and second pivot arms, first ends of the first and second pivot arms are pivotally operably attached to a first end of the first shelf, second ends of the first and second pivot arms are pivotally operably attached to the cabinet, one of the second ends of the first and second pivot arms is disposed below the second shelf, the first and second pivot arms forming a first parallelogram;

d) third and fourth pivot arms, first ends of the third and fourth pivot arms are pivotally operably attached to a second end of the first shelf, second ends of the third and fourth pivot arms are pivotally operably attached to the cabinet, one of the second ends of the third and fourth pivot arms is disposed below the second shelf, the third and fourth pivot arms forming a second parallelogram; and e) a first drive motor operably connected to one of the second ends of the first and second pivot arms and the third and fourth pivot arms to swing the first and the second parallelograms outwardly and downwardly from the cabinet to position the first shelf from the retracted position to the deployed position, wherein the second shelf in the deployed position is lower than the first shelf in the deployed position.

2. A cabinet as in claim 1, and further comprising:

a) first mounting bracket operably associated with the first end of the first shelf;

b) second mounting bracket operably associated with the second end of the first shelf; and c) the first mounting bracket and the second mounting bracket are attached to the cabinet.

3. A cabinet as in claim 2, wherein:

a) a third mounting bracket attached to each of the first end and the second end of the first shelf;

b) a fourth mounting bracket attached to each of the first mounting bracket and the second mounting bracket;

c) the first ends of the first and second pivot arms and the third and fourth pivot arms are attached to the respective third mounting brackets; and d) the second ends of the first and second pivot arms and the third and fourth pivot arms are attached to the respective fourth mounting brackets.

4. A cabinet as in claim 2, wherein the first drive motor is attached to one of the first mounting bracket and the second mounting bracket.

5. A cabinet as in claim 2, wherein:

a) the first mounting bracket and the second mounting bracket are L-shaped including first and second walls disposed transverse to each other;

b) the first walls are operably associated with a back wall of the cabinet; and c) the second walls are operably associated with respective side walls of the cabinet.

6. A cabinet as in claim 5, wherein:

a) a third mounting bracket attached to each of the first end and the second end of the first shelf;

b) a fourth mounting bracket attached to each of the second walls of the first mounting bracket and the second mounting bracket;

c) the first ends of the first and second pivot arms and the third and fourth pivot arms are attached to the respective third mounting brackets; and d) the second ends of the first and second pivot arms and the third and fourth pivot arms are attached to the respective fourth mounting brackets.

7. A cabinet as in claim 2, and further comprising:

a) fifth and sixth pivot arms, first ends of the fifth and sixth pivot arms are pivotally operably attached to a first end of the second shelf, second ends of the fifth and sixth pivot arms are pivotally operably attached to the cabinet below the second shelf, the fifth and sixth pivot arms forming a first parallelogram;

b) seventh and eighth pivot arms, first ends of the seventh and eighth pivot arms are pivotally operably attached to a second end of the second shelf, second ends of the seventh and eighth pivot arms are pivotally operably attached to the cabinet below the second shelf, the seventh and eighth pivot arms forming a second parallelogram;

c) a second drive motor operably connected to one of the second ends of the fifth and sixth pivot arms and the seventh and eighth pivot arms to swing the first and the second parallelograms outwardly and downwardly from the cabinet to position the second shelf from the retracted position to the deployed position.

8. A cabinet as in claim 7, and further comprising:

a) a third mounting bracket attached to each of the first end and the second end of the second shelf;

b) a fourth mounting bracket attached to each of the first mounting bracket and the second mounting bracket;

c) the first ends of the fifth and sixth pivot arms and the seventh and eighth pivot arms are attached to the respective third mounting brackets; and d) the second ends of the fifth and sixth pivot arms and the seventh and eighth pivot arms are attached to the respective fourth mounting brackets.

9. A cabinet as in claim 7, wherein the second drive motor is attached to one of the first mounting bracket and the second mounting bracket.

10. A cabinet as in claim 7, wherein:

a) the first mounting bracket and the second mounting bracket are L-shaped including first and second walls disposed transverse to each other;

b) the first walls are operably associated with a back wall of the cabinet; and c) the second walls are operably associated with respective side walls of the cabinet.

11. A cabinet as in claim 10, wherein:

a) a third mounting bracket attached to each of the first end and the second end of the second shelf;

b) a fourth mounting bracket attached to each of the second walls of the first mounting bracket and the second mounting bracket;

c) the first ends of the fifth and sixth pivot arms and the seventh and eighth pivot arms are attached to the respective third mounting brackets; and d) the second ends of the fifth and sixth pivot arms and the seventh and eight pivot arms are attached to the respective fourth mounting brackets.

12. A cabinet as in claim 8, wherein the first shelf in the deployed position is lower than the second shelf in the retracted position.

13. A cabinet as in claim 7, and further comprising a controller to control the first drive motor and the second drive motor individually.

14. A shelf retrofit for a cabinet hung from a wall, comprising:

a) a first shelf disposed inside the cabinet and having a retracted position and a deployed position, the first shelf including a first end and a second end;

b) a second shelf disposed inside the cabinet and below the first shelf, the second shelf being independently movable between a retracted position and a deployed position below and outwardly from the retracted position;

c) a first mounting bracket operably associated with the first end of the first shelf, the first mounting bracket being configured to be attached inside the cabinet;

d) a second mounting bracket operably associated with the second end of the first shelf, the second mounting bracket being configured to be attached inside the cabinet;

e) first and second pivot arms, first ends of the first and second pivot arms are pivotally operably attached to the first end of the first shelf, second ends of the first and second pivot arms are pivotally operably attached below the second shelf to the first mounting bracket, the first and second pivot arms forming a first parallelogram;

f) third and fourth pivot arms, first ends of the third and fourth pivot arms are pivotally operably attached to the second end of the first shelf, second ends of the third and fourth pivot arms are pivotally operably attached below the second shelf to the second mounting bracket, the third and fourth pivot arms forming a second parallelogram;

g) a first drive motor operably connected to one of the second ends of the first and second pivot arms and the third and fourth pivot arms to swing the first and the second parallelograms outwardly and downwardly from the cabinet to position the first shelf from the retracted position to the deployed position, wherein the second shelf in the deployed position is lower than the first shelf in the deployed position.

15. A cabinet as in claim 1, wherein:

a) another one of the second ends of the first and second pivot arms is disposed below the second shelf; and b) another one of the second ends of the third and fourth pivot arms is disposed below the second shelf.

* * * * *